US007109454B2

(12) United States Patent
Lee

(10) Patent No.: US 7,109,454 B2
(45) Date of Patent: Sep. 19, 2006

(54) MICROWAVE OVEN

(75) Inventor: Sung Ho Lee, Hwasung-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/981,479

(22) Filed: Nov. 5, 2004

(65) Prior Publication Data

US 2005/0173423 A1 Aug. 11, 2005

(30) Foreign Application Priority Data

Jan. 20, 2004 (KR) ..... 10-2004-0004091

(51) Int. Cl.
*H05B 6/68* (2006.01)

(52) U.S. Cl. ..... 219/715; 219/721

(58) Field of Classification Search ..... 219/715, 219/719, 702, 703, 712, 720, 494, 685, 718, 219/493, 721; 307/141; 361/23–25, 58, 361/93, 103, 115; 200/38 BA, 38 R, 38 FA, 200/35 R, 39 A See application file for complete search history.

(56) References Cited

U.S. PATENT DOCUMENTS 4,629,845 A * 12/1986 Mahon ..... 219/719

6,218,652 B1 * 4/2001 Kim et al. ..... 219/721

FOREIGN PATENT DOCUMENTS

JP 11-325471 11/1999

* cited by examiner

*Primary Examiner*—Quang Van
(74) *Attorney, Agent, or Firm*—Sughrue Mion, PLLC

(57) ABSTRACT

A microwave oven is provided with an integrated operating unit having an integrated function for power supply, power level control, and inrush current suppression. The integrated operating unit includes a rotary dial, a shaft fixed, at one end thereof, to the rotary dial, a cam mounted about a concentric axis of the shaft to be rotated along with the shaft, and an iron core extending, at one end thereof, from the other end of the shaft away from the shaft beyond the cam. A relay coil is wound around the iron core. The integrated operating unit further includes a power switch attached to a support member extending from the other end of the iron core away from the iron core, an inrush switch for suppressing inrush current, and a power control switch for controlling the power supply time in accordance with a set power level.

16 Claims, 6 Drawing Sheets

MICROWAVE OVEN

CROSS-REFERENCE TO RELATED APPLICATION

This application claims the priority of Korean Patent Application No. 2004-4091, filed on Jan. 20, 2004 in the Korean Intellectual Property Office, the disclosure of which is incorporated herein in its entirety by reference.

BACKGROUND OF THE INVENTION

1. Field of the Invention

An apparatus consistent with the present invention relates to a microwave oven provided with an integrated operating unit having an integrated function for power supply, power level control, and inrush current suppression.

2. Description of the Related Art

Microwave ovens are classified into an electronic type, in which a cooking operation is carried under the control of a microcomputer, and a mechanical type, in which a cooking operation is carried out under a cooking condition set in accordance with a user's manual operation. Mechanical microwave ovens use a timer switch for setting a cooking time, a variable power control (VPC) switch for controlling the level of power, and an inrush switch for suppressing inrush current. However, these switches must be individually provided, there are problems in that the number of constituent elements in such a mechanical microwave oven increases, thereby causing an increase in the number of assembly processes, and an increase in manufacturing costs.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

An apparatus consistent with the present invention has been made in view of the above mentioned problems, and one aspect of the invention provides a microwave oven provided with an integrated operating unit having an integrated function for power supply, power level control, and inrush current suppression, thereby being capable of achieving a reduction in the number of assembly processes and a reduction in manufacturing costs.

In accordance with a first aspect, the present invention provides a microwave oven that comprises an AC power source, a high-voltage transformer, and an integrated operating unit electrically connected between the AC power source and the high-voltage transformer. The integrated operating unit includes a first switch member adapted to supply power from the AC power source in accordance with a user's operation, and a second switch member adapted to control a power level of the microwave oven in accordance with a user's operation.

In accordance with the first aspect, the integrated operating unit may further comprise a rotary dial, and a shaft fixed to the rotary dial. The first and second switch members may perform their switching operations in a sequential manner in accordance with operations of the rotary dial and shaft.

In accordance with the first aspect, the integrated operating unit may further comprise a third switch member for suppressing inrush current in accordance with a user's operation.

In accordance with the first aspect, the first switch member may comprise a power switch for electrically connecting first and second contacts in accordance with the operation of the shaft.

In accordance with the first aspect, the third switch member may comprise an iron core extending from the shaft, a relay coil wound around the iron core, an inrush resistor adapted to attenuate the inrush current, and an inrush switch adapted to electrically connect third and fourth contacts when a magnetic force is generated from the core as current flows through the relay coil.

In accordance with the first aspect, the inrush switch may be a plate spring having two legs.

In accordance with the first aspect, the second switch member may comprise a cam adapted to be rotated along with the shaft, and a power control switch adapted to set the power level in accordance with the rotation of the cam.

In accordance with the first aspect, the cam may have a cam surface spaced apart from a center of the shaft by a distance increasing as the power level increases.

In accordance with the first aspect, the power control switch may comprise fixed and movable members hingably movable to repeat the supply of power and cutting-off of the power supply in such a fashion that the power supply is carried out for a longer time at a higher power level.

In accordance with the first aspect, the fixed member may have a single metal structure, and the movable member may have a bimetal structure.

In accordance with a second aspect, the present invention provides a microwave oven including a cabinet, comprising an AC power source, a high-voltage transformer, a control knob provided at the cabinet, and adapted to set a cooking condition in accordance with a user's operation, a first switch member for supplying power from the AC power source in accordance with an operation of the control knob, and a second switch member for controlling a time, for which the power is supplied, and a time, for which the supply of power is cut off, such that the power supply and cut-off times are varied in accordance with a power level of the microwave oven. A third switch member is provided for suppressing inrush current generated when the power is supplied to the high-voltage transformer via the first and second switch members.

In accordance with the second aspect, the third switch member may comprise an iron core, a relay coil, an inrush resistor adapted to attenuate the inrush current, and an inrush switch adapted to electrically connect contacts respectively connected to opposite ends thereof when a magnetic force is generated from the core as current flows through the relay coil.

In accordance with the second aspect, the inrush switch may be a plate spring having two legs.

In accordance with the second aspect, the second switch member may include a rotating cam, and a power control switch adapted to set the power level in accordance with a rotation of the cam.

In accordance with the second aspect, the cam may have a cam surface spaced apart from a rotation axis of the cam by a distance increasing as the power level increases.

In accordance with the second aspect, the power control switch may comprise fixed and movable members hingably movable to repeat the supply of power and cutting-off of the power supply in such a fashion that the power supply is carried out for a longer time at a higher power level.

In accordance with the second aspect, the fixed member may have a single metal structure, and the movable member may have a bimetal structure.

BRIEF DESCRIPTION OF THE DRAWINGS

The above and other features and advantages of the present invention will become more apparent by describing in detail exemplary embodiments thereof with reference to the attached drawings, in which.

DETAILED DESCRIPTION OF ILLUSTRATIVE, NON-LIMITING EMBODIMENTS OF THE INVENTION

The present invention will now be described more fully with reference to the annexed drawings in which illustrative, non-limiting embodiments of the invention are shown.

Figure 1:
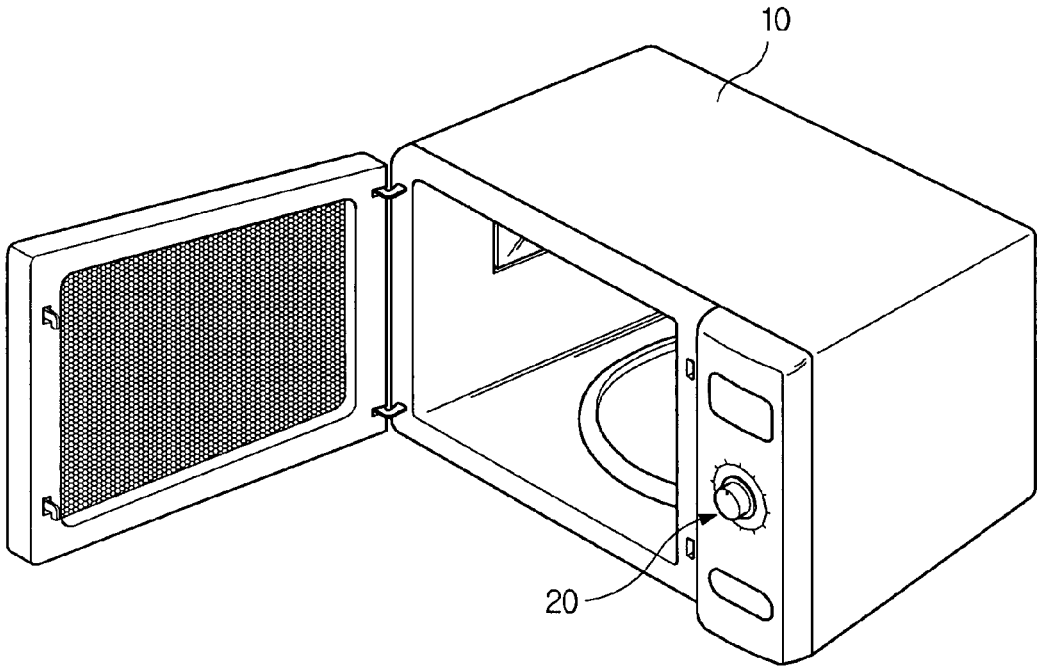
FIG. 1 is a perspective view illustrating the appearance of a microwave oven according to an exemplary embodiment of the present invention.

An exemplary embodiment of the present invention is applied to a mechanical microwave oven, in which a cooking condition is set by the user. Referring to FIG. 1, this mechanical microwave oven includes an integrated operating unit 20 provided at a front wall of a cabinet 10.

Figure 2:
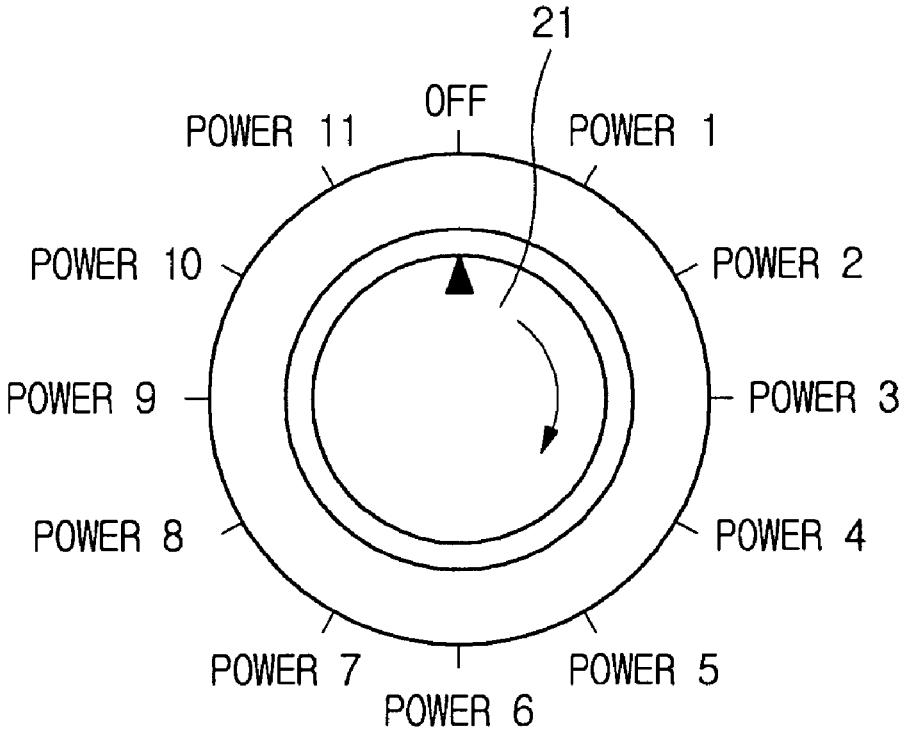
FIG. 2 is a schematic view illustrating a rotary dial included in an integrated operating unit shown in FIG. 1.
Figure 3:
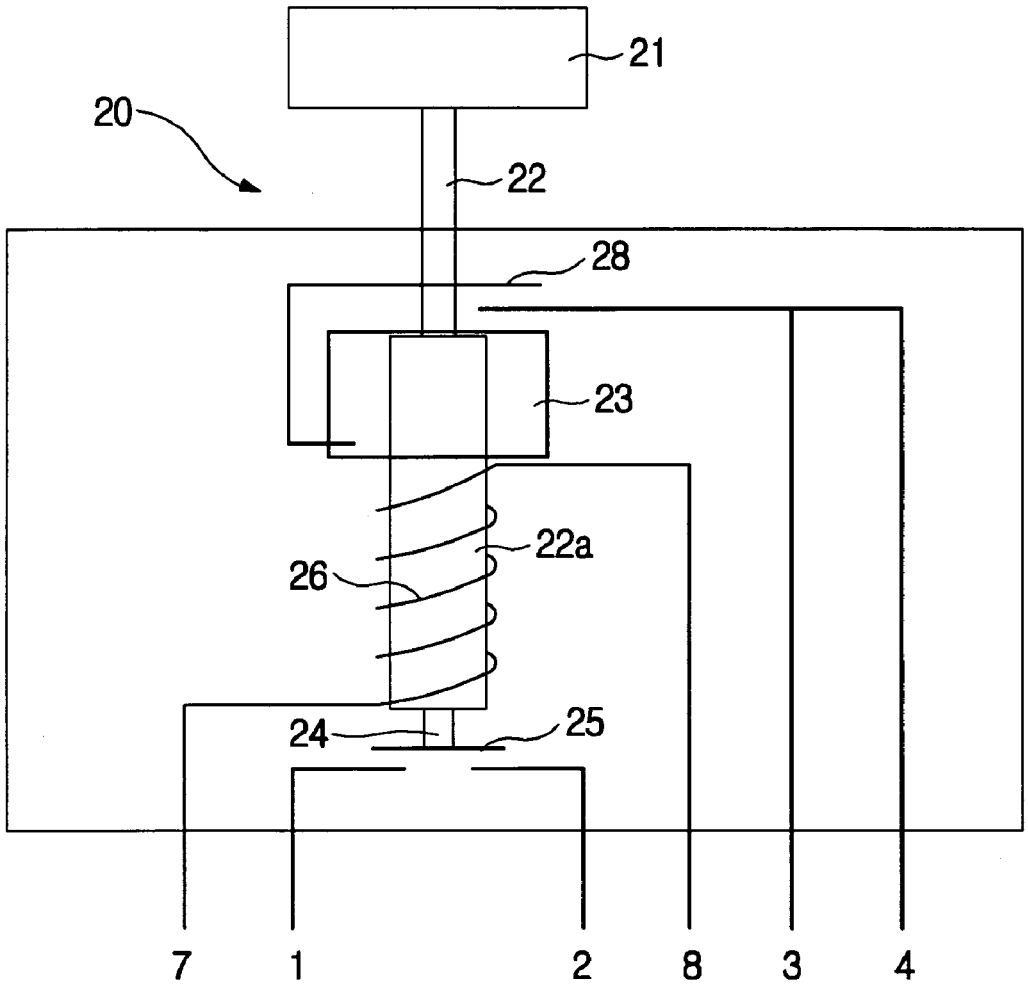
FIG. 3 is a schematic view illustrating a configuration of the integrated operating unit shown in FIG. 1.

As shown in FIG. 2, the integrated operating unit 20 includes a rotary dial 21 adapted to set a cooking condition while being rotated in accordance with a manual operation of the user.

When the rotating dial 21 is positioned such that its reference position marked by "▲" indicates a power-off mark OFF marked on the front wall of the cabinet 10 around the rotary dial 21, no power is supplied to the microwave oven. When the user rotates the rotary dial 21 in a clockwise direction (indicated by an arrow in FIG. 2) while pressing the rotary dial 21, the reference position ▲ of the rotary dial 21 may indicate any one of power level marks POWER 1 to POWER 11 marked on the front wall of the cabinet 10 around the rotary dial 21. In this state, the microwave oven is switched to its power-on state. That is, power is supplied to the microwave oven, and simultaneously, the power level of the microwave oven is set to the power level corresponding to the power level mark, which is indicated by the reference position ▲ of the rotary dial 21.

The integrated operating unit 20 also includes a shaft 22 fixed, at one end thereof, to the rotary dial 21, a cam 23 mounted about a concentric axis of the shaft 22 to be rotated along with the shaft 22, and an iron core 22*a* extending, at one end thereof, from the other end of the shaft 22 away from the shaft 22 beyond the cam 22. A relay coil 26 is wound around the iron core 22*a*. The integrated operating unit 20 further includes a power switch 25 attached to a support member 24 extending from the other end of the iron core 22*a* away from the iron core 22*a*, and an inrush switch 28 for suppressing inrush current.

In addition, the integrated operating unit 20 includes a power control switch 29 for controlling the power supply time in accordance with the set power level.

When the rotary dial 21 is pressed, the shaft 22 operatively connected thereto is pressed, thereby causing the power switch 25 to electrically connect first and second contacts 1 and 2.

Figure 4:
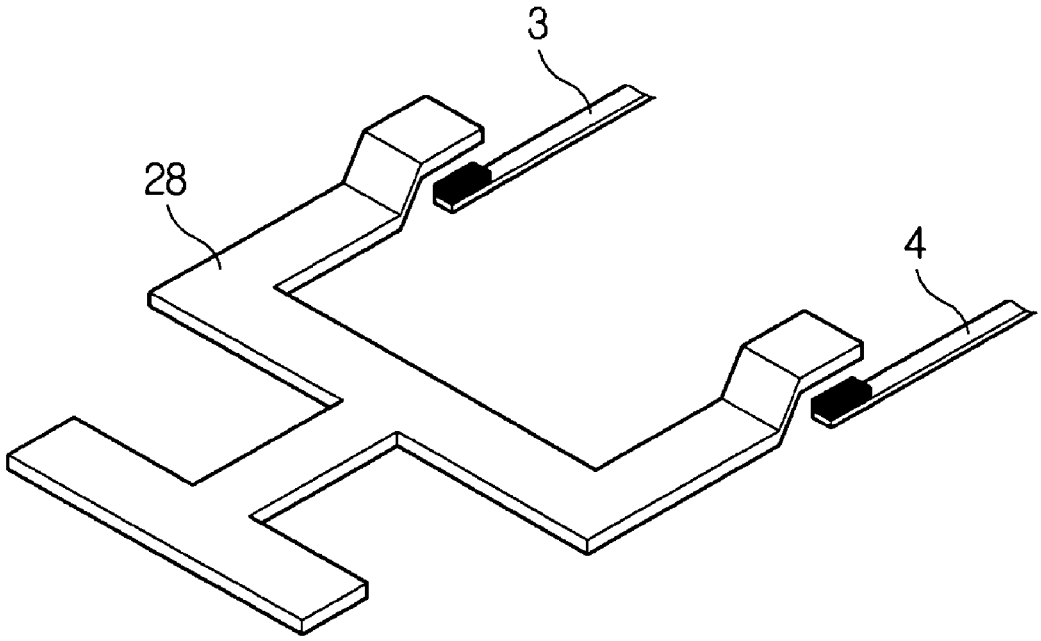
FIG. 4 is an enlarged perspective view illustrating an inrush switch included in the integrated operating unit of FIG. 3.

The inrush switch 28 has a plate spring structure with two legs, as shown in FIG. 4. When current flows through the relay coil 26 wound around the iron core 22*a*, a magnetic force is generated. By virtue of this magnetic force, the legs of the inrush switch 28 electrically connect third and fourth contacts 3 and 4.

Figure 5:
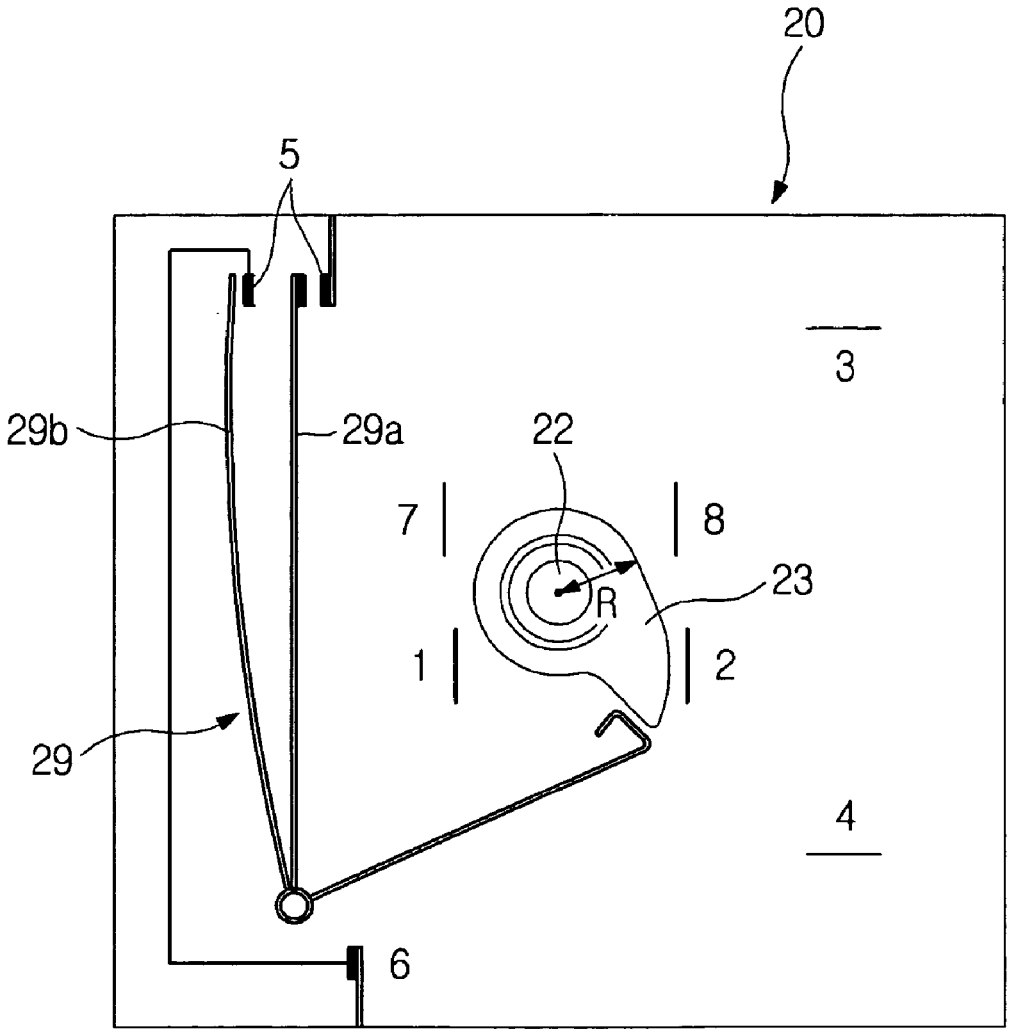
FIG. 5 is a schematic view illustrating a power control switch included in the integrated operating unit of FIG. 3.

The power control switch 29 serves to electrically connect fifth and sixth contacts 5 and 6 in accordance with rotation of the cam 23, as shown in FIG. 5. The power control switch 29 includes a fixed member 29*a* and a movable member 29*b*, which are hingably coupled to an axis parallel to the axis of the cam 23. The fixed member 29*a* has a single metal structure, whereas the movable member 29*b* has a bimetal structure. When an external force is applied to the power control switch 29 in accordance with rotation of the cam 23, the fixed member 29*a* and movable member 29*b* are electrically connected to the fifth contact 5. That is, both the fixed member 29*a* and the movable member 29*b* come into contact with the fifth contact 5 in accordance with the rotation of the cam 23. However, since the movable member 29*b* is made to initially have a longitudinally bent structure, it is rendered straight after a predetermined time elapses from the time when it comes into contact with the fifth contact 5, so that it is separated from the fifth contact 5, thereby releasing its electrical connection to the sixth contact 6. Here, the predetermined time is proportional to the power level set in accordance with rotation of the rotary dial 21. When the set power level is higher, that is, when the reference position of the rotary dial 21 is nearer to a position corresponding to the maximum power level POWER 11, the radial distance R from the center of the cam 23 to the cam surface of the cam 23 is longer, so that the external force applied to the power control switch 29 by the cam 23 is larger. In this state, the force urging the fixed member 29*a* and movable member 29*b* toward the fifth contact 5 is also larger.

Figure 6:
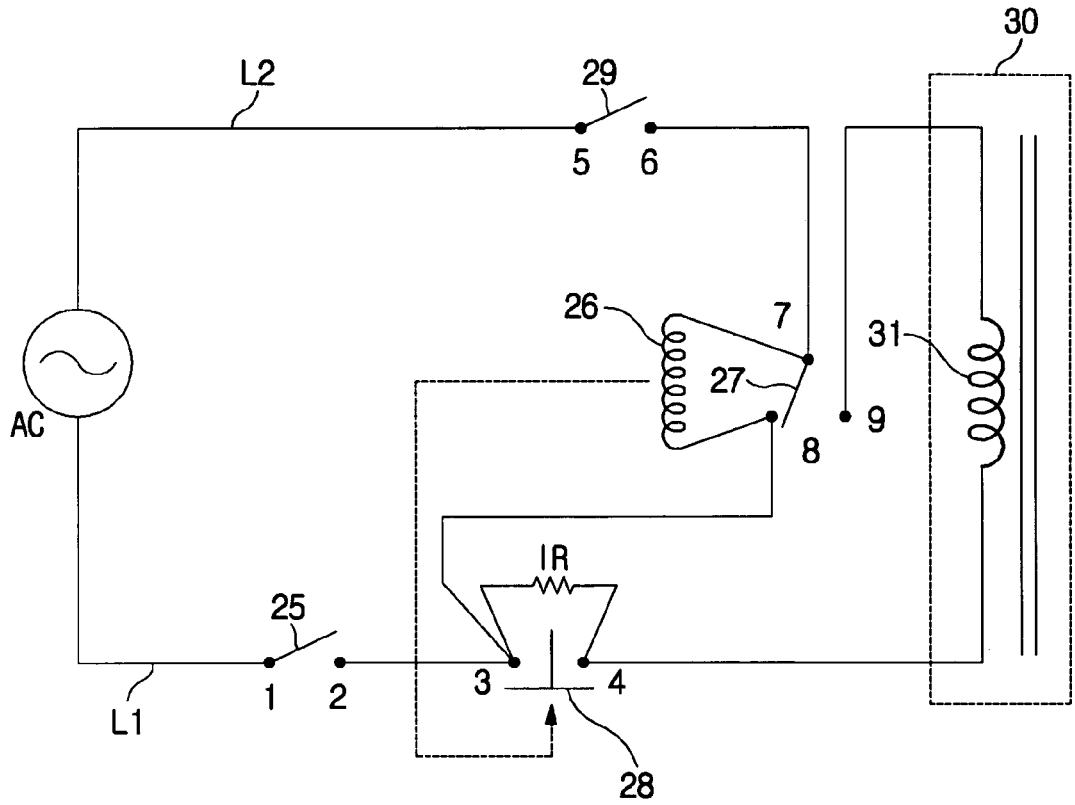
FIG. 6 is a circuit diagram illustrating an electric circuit applied to the microwave oven according to the illustrated embodiment of the present invention.

FIG. 6 is a circuit diagram illustrating an electric circuit applied to the microwave oven according to the illustrated embodiment of the present invention.

As shown in FIG. 6, the microwave oven of the present invention includes a commercial AC power source AC, a high-voltage transformer 30, and AC lines L1 and L2 for electrically connecting the power source AC and high-voltage transformer 30. The power switch 25 and inrush switch 20 are electrically connected in series between the first AC line L1 and one end of a primary coil 31 of the high-voltage transformer 30. The power control switch 29 and monitor switch 27 are electrically connected in series between the second AC line L2 and the other end of the primary coil 31 of the high-voltage transformer 30. An inrush resistor IR is connected between the third and fourth contacts 3 and 4 electrically connectable by the inrush switch 28. An eighth contact 8 is electrically connected to the third contact 3, in order to electrically connect the power switch 25 and relay coil 26 in series.

Operation of the microwave oven having the above described configuration according to an exemplary embodiment of the present invention will now be described.

After connecting a power plug (not shown) of the microwave oven to a receptacle electrically connected to an external power source, putting food into the cooking chamber, and closing a door to close the cooking chamber, the user sets a cooking condition by operating the integrated operating unit 20.

When the user presses the rotary dial 21, the power switch 25 mounted to the shaft 22 is shifted to electrically connect the first and second contacts 1 and 2. When the user rotates the rotary dial 21 in this state such that it indicates a desired power level, the cam 23 applies an external force to the power level switch 29 while being rotated. As a result, the fixed member 29*a* and movable member 29*b* of the power level switch 29 electrically connect the fifth and sixth contacts 5 and 6. At this time, the monitor switch 27 electrically connects the seventh contact 7 to a ninth contact 9 connected to the other end of the primary coil 31 of the high-voltage transformer 30. Thus, a closed circuit is established between the commercial AC power source AC and the primary coil 31 of the high-voltage transformer 30, so that supply of power is initiated. In such an initial power supply stage, the inrush switch 28 is maintained in its OFF state. Accordingly, attenuation of inrush current is carried out by the inrush resistor IR. The attenuated current flows through the primary coil 31.

At this time, current also flows through the relay coil 26 wound around the iron core 22*a*, so that the iron core 22*a* functions as an electromagnet, thereby generating a magnetic force. By virtue of this magnetic force, the legs of the inrush switch 28 electrically connect the third and fourth contacts 3 and 4. This electrical connection is achieved after a predetermined time (for example, 300 ms) has elapsed from the time when the supply of power was initiated. From the time when the above electrical connection is achieved, normal current can flow through the primary coil 31 via the inrush switch 28.

A cooking operation is carried out in accordance with oscillation of a magnetron (not shown) activated as power is supplied to the high-voltage transformer 30. As the cooking operation proceeds, that is, when power of a set level is supplied for a certain time, the power control switch 29 increases in temperature due to the current flowing therethrough. As a result, the movable member 29*b* of the power control switch 29 is straightened against the external force applied thereto, so that it is separated from the fifth contact 5, thereby releasing its electrical connection to the sixth contact 6. Accordingly, no current flows through the relay coil 26, so that the inrush switch 28 is switched off.

Also, the supply of power to the primary coil 31 of the high-voltage transformer 30 is cut off, thereby stopping the oscillation of the magnetron. At this time, the power switch 25 maintains the electrical connection between the first and second contacts 1 and 2.

After the power supply is cut off, the power control switch 29 decreases in temperature, so that its movable member 29*b* recovers its original bent shape.

Accordingly, the movable member 29*b* again comes into contact with the fifth contact 5, so that it is electrically connected to the sixth contact 6. In this state, current again flows through the relay coil 26, thereby causing the inrush switch 28 to be switched on. Accordingly, power is again supplied to the high-voltage transformer 30.

Thus, the power control switch 29 can perform power control during a cooking operation carried out in accordance with the oscillation of the magnetron by repeating operations of supplying power of a set level and cutting off the supply of power.

As apparent from the above description, the microwave oven of the present invention uses an integrated operating unit having an integrated function for power supply, power level control, and inrush current suppression. Accordingly, the present invention is effective infachieving a reduction in the number of assembly processes and a reduction in manufacturing costs.

Although exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising:

an AC power source;

a high-voltage transformer; and an integrated operating unit electrically connected between the AC power source and the high-voltage transformer, the integrated operating unit comprising a first switch member adapted to supply power from the AC power source in accordance with a user's operation, a second switch member adapted to control a power level of the microwave oven in accordance with a user's operation, and a third switch member for suppressing inrush current in accordance with a user's operation, wherein the integrated operating unit further comprises a rotary dial and a shaft fixed to the rotary dial, so that the first, second and third switch members are disposed along the shaft so as to perform their switching operations in accordance with the rotation of the rotary dial and the shaft, wherein the rotary dial is a control knob having an integrated function for power supply, power level control, and inrush current suppression in accordance with a user's operation.

2. The microwave oven according to claim 1, wherein the first and second switch members perform their switching operations in a sequential manner in accordance with operations of the rotary dial and shaft.

3. The microwave oven according to claim 2, wherein the first switch member comprises a power switch for electrically connecting first and second contacts in accordance with the operation of the shaft.

4. The microwave oven according to claim 2, wherein the second switch member comprises a cam adapted to be rotated along with the shaft, and a power control switch adapted to set the power level in accordance with the rotation of the cam.

5. The microwave oven according to claim 4, wherein the cam has a cam surface spaced apart from a center of the shaft by a distance increasing as the power level increases.

6. The microwave oven according to claim 4, wherein the power control switch comprises fixed and movable members hingably movable to repeat the supply of power and cutting-off of the power supply so that the power supply is carried out for a predetermined time that is proportional to the power level.

7. A microwave oven comprising:

an AC power source;

a high-voltage transformer; and an integrated operating unit electrically connected between the AC power source and the high-voltage transformer, the integrated operating unit comprising a first switch member adapted to supply power from the AC power source in accordance with a user's operation, and a second switch member adapted to control a power level of the microwave oven in accordance with a user's operation, and a third switch member for suppressing inrush current in accordance with a user's operation, wherein the third switch member comprises an iron core extending from the shaft, a relay coil wound around the iron core, an inrush resistor adapted to attenuate the inrush current, and an inrush switch adapted to electrically connect third and fourth contacts when a magnetic force is generated from the core as current flows through the relay coil.

8. The microwave oven according to claim 7, wherein the inrush switch is a plate spring having two legs.

9. A microwave oven comprising:

an AC power source;

a high-voltage transformer; and an integrated operating unit electrically connected between the AC power source and the high-voltage transformer, the integrated operating unit comprising a first switch member adapted to supply power from the AC power source in accordance with a user's operation, and a second switch member adapted to control a power level of the microwave oven in accordance with a user's operation, and a third switch member for suppressing inrush current in accordance with a user's operation, wherein the integrated operating unit further comprises:

a rotary dial; and a shaft fixed to the rotary dial, wherein the first and second switch members perform their switching operations in a sequential manner in accordance with operations of the rotary dial and shaft, wherein the second switch member comprises a cam adapted to be rotated along with the shaft, and a power control switch adapted to set the power level in accordance with the rotation of the cam, wherein the power control switch comprises fixed and movable members hingably movable to repeat the supply of power and cutting-off of the power supply so that the power supply is carried out for a predetermined time that is proportional to the power level wherein the fixed member has a single metal structure, and the movable member has a bimetal structure.

10. A microwave oven including a cabinet, comprising:

an AC power source;

a high-voltage transformer;

a control knob provided at the cabinet, and adapted to set a cooking condition in accordance with a user's operation;

a first switch member for supplying power from the AC power source in accordance with an operation of the control knob;

a second switch member for controlling a time, for which the power is supplied, and a time, for which the supply of power is cut off, such that the power supply and cut-off times are varied in accordance with a power level of the microwave oven; and a third switch member for suppressing inrush current generated when the power is supplied to the high-voltage transformer via the first and second switch members, wherein the control knob has an integrated function for power supply, power level control, and inrush current suppression.

11. The microwave oven according to claim 10, wherein the second switch member comprises a rotating cam, and a power control switch adapted to set the power level in accordance with a rotation of the cam.

12. The microwave oven according to claim 11, wherein the cam has a cam surface spaced apart from a rotation axis of the cam by a distance increasing as the power level increases.

13. The microwave oven according to claim 11, wherein the power control switch comprises fixed and movable members hingably movable to repeat the supply of power and cutting-off of the power supply in such a fashion that the power supply is carried out for a predetermined time that is proportional to the power level.

14. A microwave oven including a cabinet, comprising:

an AC power source;

a high-voltage transformer;

a control knob provided at the cabinet, and adapted to set a cooking condition in accordance with a user's operation;

a first switch member for supplying power from the AC power source in accordance with an operation of the control knob;

a second switch member for controlling a time, for which the power is supplied, and a time, for which the supply of power is cut off, such that the power supply and cut-off times are varied in accordance with a power level of the microwave oven; and a third switch member for suppressing inrush current generated when the power is supplied to the high-voltage transformer via the first and second switch members, wherein the third switch member comprises an iron core, a relay coil, an inrush resistor adapted to attenuate the inrush current, and an inrush switch adapted to electrically connect contacts respectively connected to opposite ends thereof when a magnetic force is generated from the core as current flows through the relay coil.

15. The microwave oven according to claim 14, wherein the inrush switch is a plate spring having two legs.

16. A microwave oven including a cabinet, comprising:

an AC power source;

a high-voltage transformer;

a control knob provided at the cabinet, and adapted to set a cooking condition in accordance with a user's operation;

a first switch member for supplying power from the AC power source in accordance with an operation of the control knob;

a second switch member for controlling a time, for which the power is supplied, and a time, for which the supply of power is cut off, such that the power supply and cut-off times are varied in accordance with a power level of the microwave oven; and a third switch member for suppressing inrush current generated when the power is supplied to the high-voltage transformer via the first and second switch members, wherein the second switch member comprises a rotating cam, and a power control switch adapted to set the power level in accordance with a rotation of the cam, wherein the power control switch comprises fixed and moveable members hingably movable to repeat the supply of power and cutting-off of the power supply in such a fashion that the power supply is carried out for a predetermined time that is proportional to the power level, wherein the fixed member has a single metal structure, and the movable member has a bimetal structure.

* * * * *